US005396738A

United States Patent [19]

Vianna

[11] Patent Number: 5,396,738

[45] Date of Patent: Mar. 14, 1995

[54] SYSTEM TO GATHER PARTICULATE MATTER IN SANDBLASTING WORK

[75] Inventor: Jeferson F. Vianna, Santos, Brazil

[73] Assignee: Petroleo Brasileiro S.A. - Petrobras, Rio de Janeiro, Brazil

[21] Appl. No.: 140,619

[22] Filed: Oct. 25, 1993

[30] Foreign Application Priority Data

Oct. 30, 1992 [BR] Brazil ..... 9204236

[51] Int. Cl.[6] ..... B24C 9/00

[52] U.S. Cl. ..... 451/87; 451/89

[58] Field of Search ..... 51/410, 424, 425, 426, 51/411, 429

[56] References Cited

U.S. PATENT DOCUMENTS

| | | | |
|---|---|---|---|
| 3,581,441 | 6/1971 | Hulbert, Jr. | 51/411 |
| 4,199,905 | 4/1980 | Neidigh et al. | 51/429 |
| 4,649,672 | 3/1987 | Thomann | 51/424 |
| 4,787,179 | 11/1988 | Lewis | 51/424 |
| 4,852,307 | 8/1989 | Goudeau | 51/424 |
| 4,949,512 | 8/1990 | Thomann | 51/424 |
| 5,185,183 | 2/1993 | Gonda et al. | 51/411 |

FOREIGN PATENT DOCUMENTS

| | | | |
|---|---|---|---|
| 0365707 | 5/1990 | European Pat. Off. | 51/410 |
| 0396815 | 11/1990 | European Pat. Off. | 51/410 |

*Primary Examiner*—Robert A. Rose

*Attorney, Agent, or Firm*—Sughrue, Mion, Zinn, Macpeak & Seas

[57] ABSTRACT

A system to gather particular matter in sandblasting work operates to contain, wet and lead away particles of matter when sandblasting tanks. It consists of four separately operating airtight sub-systems: a first sub-system consisting of a containing tower raised on scaffolding resting on the pavement of the tank, rising above tank bracing and extending down inside the wall of a tank; a second sub-system held against the inside of the tank wall above the roof and consisting of a mobile holding chamber moved by means of pulleys and held against the tank wall by tighteners; a third sub-system to operate on the outside of the tank roof and consisting of a holding chamber; and a fourth sub-system to operate on the inside of the tank roof and on the inside of the tank wall below the roof, and in which particles of matter are contained by the shape of the area itself that is to be sandblasted.

6 Claims, 14 Drawing Sheets

SYSTEM TO GATHER PARTICULATE MATTER IN SANDBLASTING WORK

BACKGROUND OF THE INVENTION

The invention concerns a system to gather particulate matter in the cleaning of large storage tanks by sandblasting so as to prevent particulate matter from being released into the surrounding atmosphere.

Large storage tanks have to undergo regular cleaning so as to remove scale, rust and other matter before any painting or other surface treatment can be done. This is usually done along with the blasting of surfaces with suitable abrasives and well-known devices meant to treat all of the surface of a tank evenly. However such sandblasting of all of the outside and inside and top and bottom of a tank causes the surrounding area to become laden with particulate matter which issues into the outside atmosphere raising the content of such matter therein.

There is therefore a need to provide some kind of system to gather such particulate matter when sandblasting is being done so as to prevent it from being released into the surrounding area and from there to the outside atmosphere.

SUMMARY OF THE INVENTION

This invention provides a system to gather particulate matter in sandblasting work, the principle of which is to contain, wet and lead away the particulate matter when sandblasting tanks and consists of four separately operating airtight systems, the first of which is meant to work on the outside wall of the tank and which consists of a containing tower standing on scaffolding resting on tank pavement, and rising above tank bracing then coming down along the inside of the tank wall, The second sub-system is intended to work against the inside of the tank wall above its roof and consists of a mobile retaining chamber worked by pulleys and which is held against the tank wall by means of tighteners. The third sub-system is meant to work on the outside of the tank roof and consists of a containing chamber, while the fourth sub-system is intended to work inside the tank (bottom, roof, inside tank wall, inside below roof) wherein actual containing of particulate matter is achieved by the shape of area to be sandblasted.

BRIEF DESCRIPTION OF THE DRAWINGS

A more detailed description of the invention follows with the help of the drawings attached hereto.

DETAILED DESCRIPTION OF THE INVENTION

As is to be seen from the Figures, the system to gather particulate matter in sandblasting work, which principle is based on containing, setting the particles by wetting and then leading away, has four separately operating and airtight sub-systems.

Figure 1:
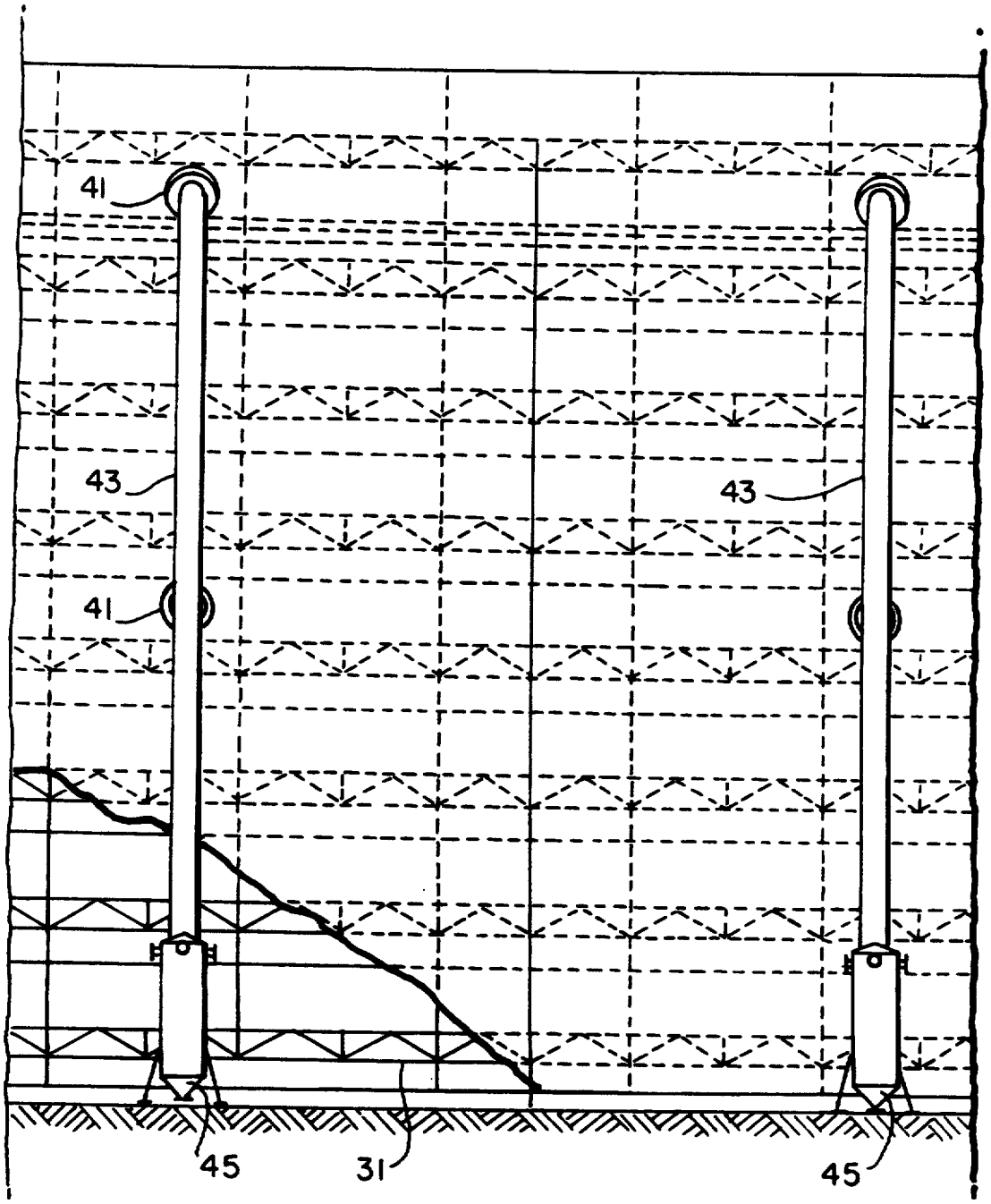
FIGS. 1, 2 and 3 are front, side and top views respectively of the first sub-system that is to work at the outside of a tank wall.
Figure 2:
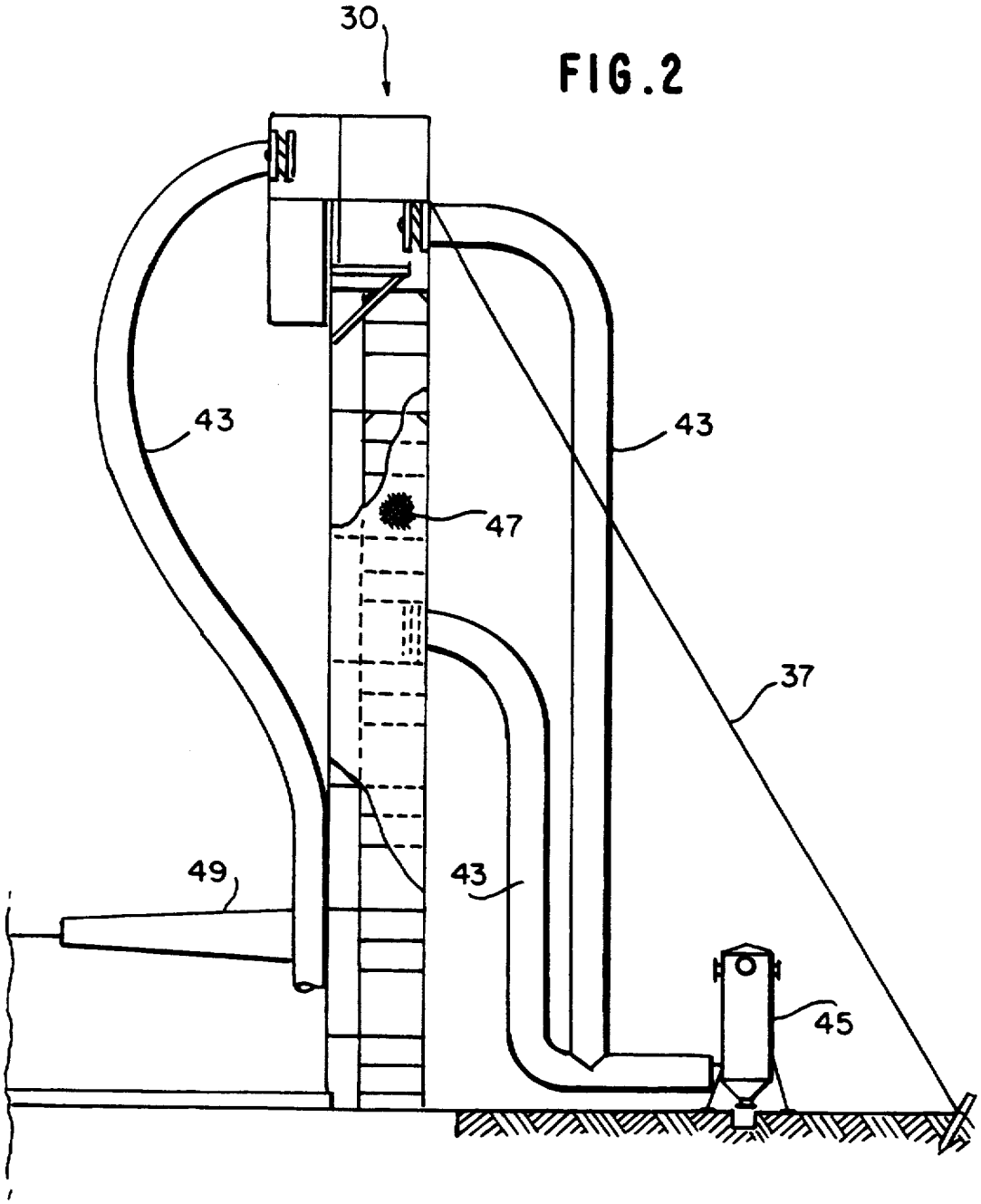
Figure 3:
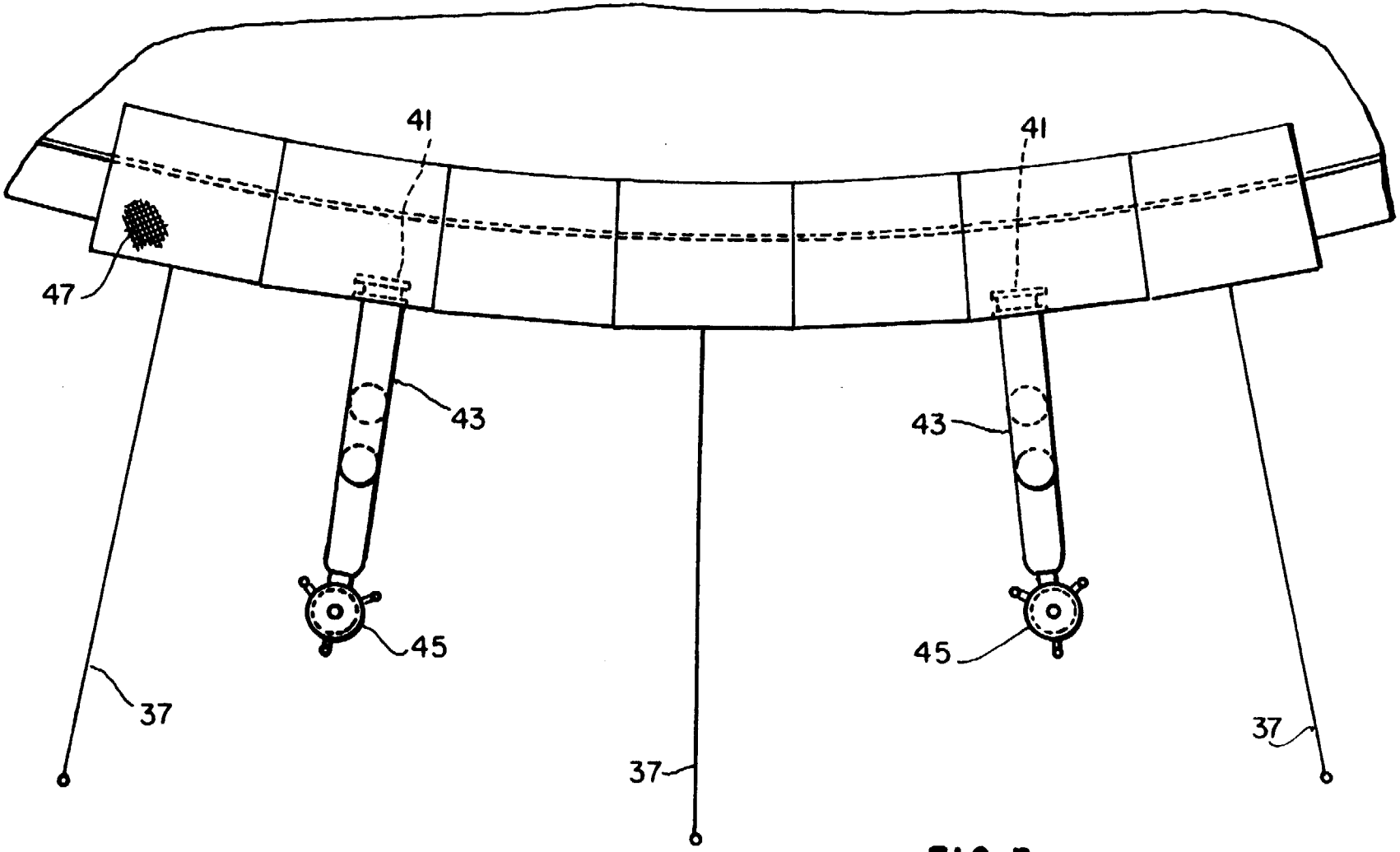
Figure 4:
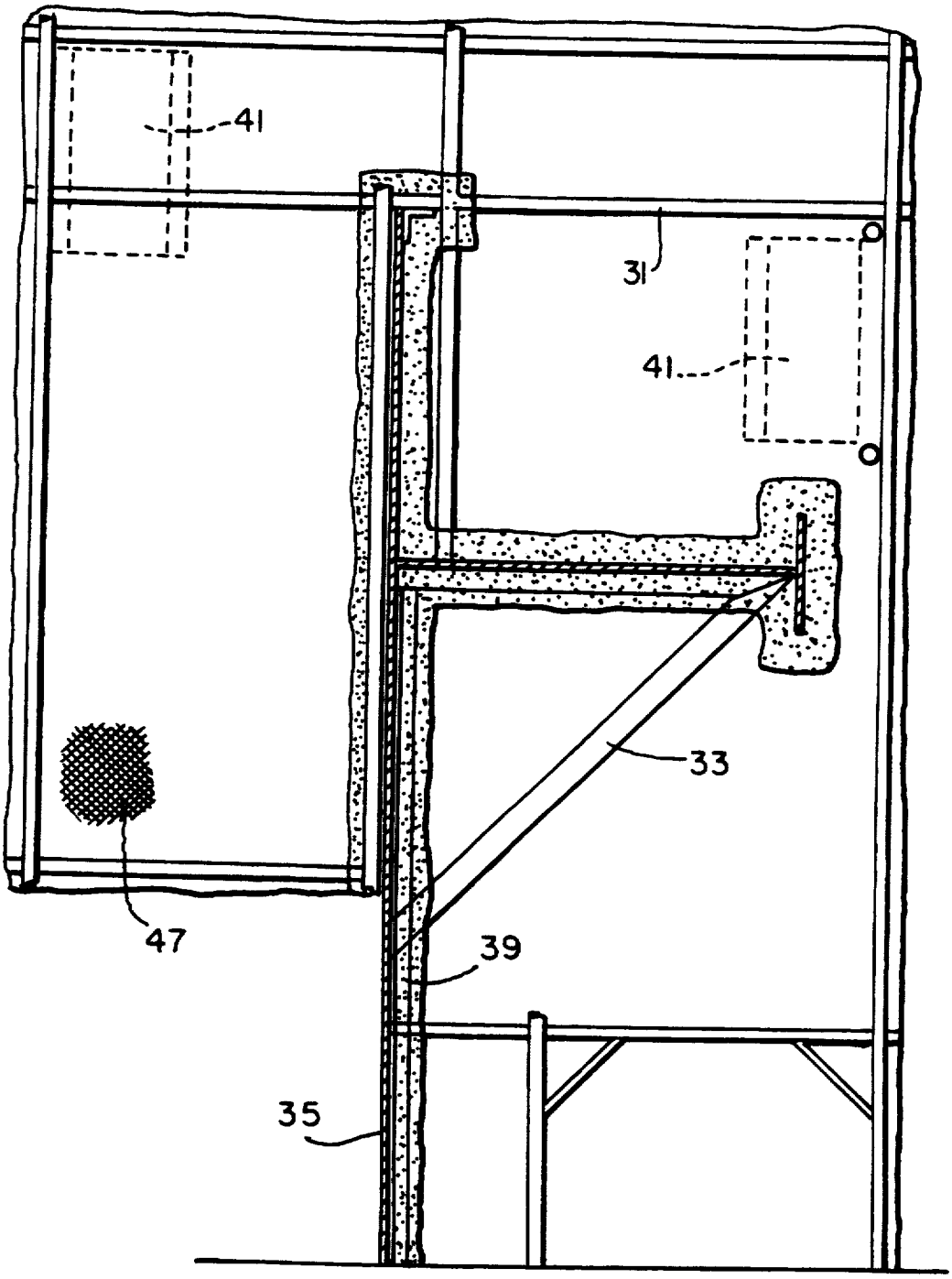
FIGS. 4 and 5 show enlarged details of FIG. 2.
Figure 5:
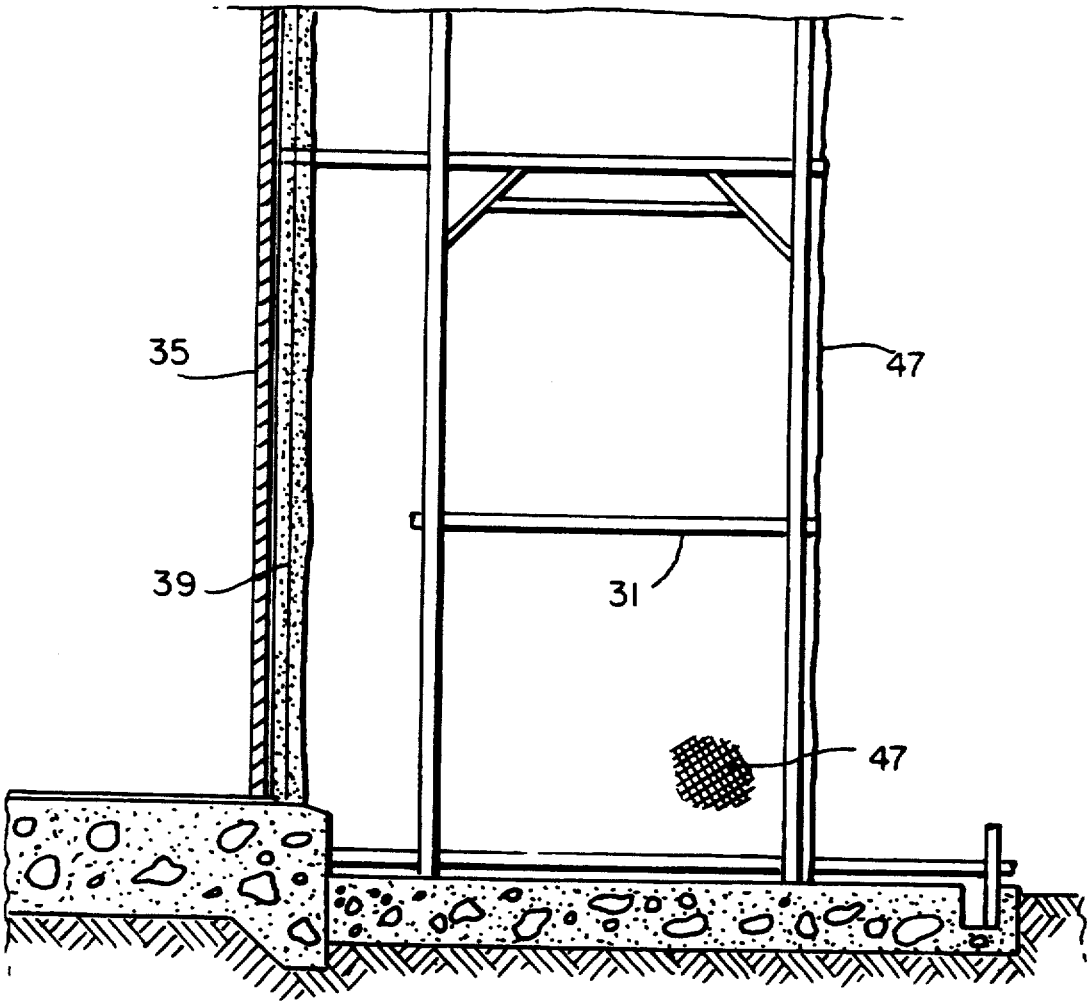
Figure 6:
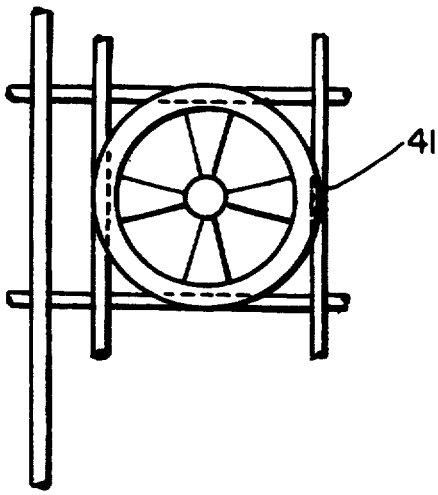
FIG. 6 shows details of how blower is fastened.

The first sub-system, shown FIGS. 1 to 8, and which is intended to work against the outside wall of the tank, consists of a containing tower (30) standing on pipe scaffolding (31) resting on tank pavement, rising above tank bracing (33) and running down the inside wall of the tank (35), said containing tower (30) rises above foam spreader bulkheads and is provided with steel guy ropes fixed into the floor of the containing chamber to ensure further stability for containing tower (30). Sealing between containing tower (30), tank bracing (33) and tank wall (35) is further added to with foam rubber or air-filled canvas conduits (39). At every 20 meters stretch of the containing tower (30) there are four blowers (41) at the outside tank wall (35), two of them at different heights, and a further two in the tank bracing area, inside the tank. From each blower (41) there issues a canvas conduit (43) about 60 centimeters in diameter, running to the wet dust collector (45) lying below, and all of the arrangement are covered with canvas (47). FIG. 2 also shows the roof of tank (49).

Figure 8:
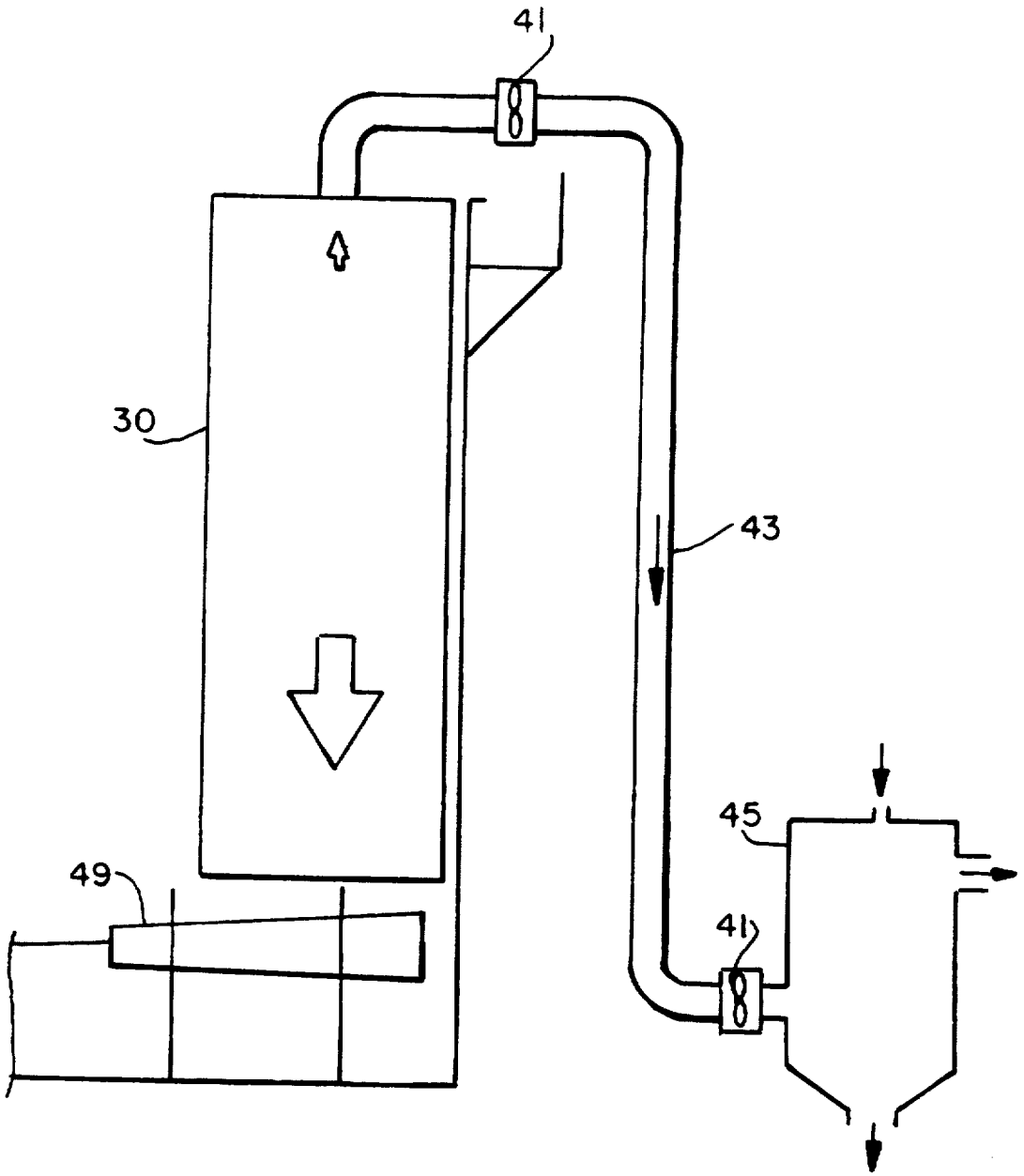
FIG. 8 is a schematic view of the system as a whole.

As it to be seen in FIG. 8, canvas ducts (43) convey particle-bearing air to wet dust collectors (45) where particles are separated out. Blowers (41) standing at inlet to collectors (45) help to keep particles flowing, and at collectors (45), water helps to separate the particles of sand, which drop wet into the channel leading into the bowl of the tank in which they gather while clean air is released into the atmosphere, Four blasters are expected to be working at the same time, two at each level. After calculating for four blasting nozzles it was concluded that yield from the first sub-system should be 92%, which is a satisfactory figure, and clean air containing about 30 $mg/m^3$ of sand particles at 2 to 3 micra in size should be released into the atmosphere.

Figure 7:
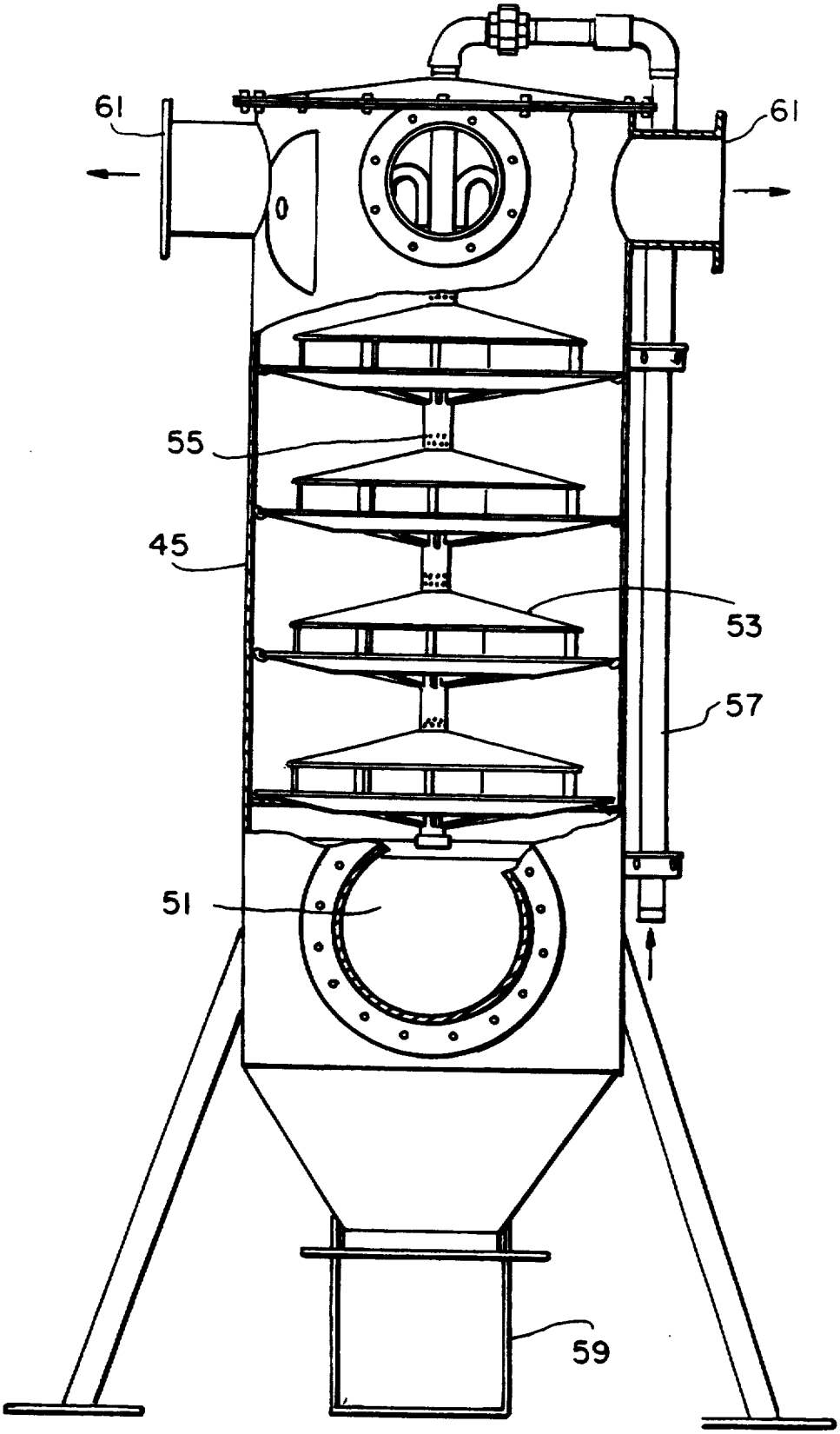
FIG. 7 is a front view partially broken away, of a wet dust gatherer.

At wet dust collector (45) shown in greater detail in FIG. 7, it is water that drags away the particles of matter. Air plus particles enter at side inlet (51) to collector (45) and are obliged to travel along an upward turning rotating path through the batteries of high curves (53) which help to throw the particles of matter together with jets of water in the opposite direction coming from the openings (55), lying above each battery in the water distributing pipe (57). The wet particles of matter and the water issue from lower opening (59), which lies upon tank duct, and they are then collected. Clean air is released into the atmosphere through the four upper openings (61).

Figure 9:
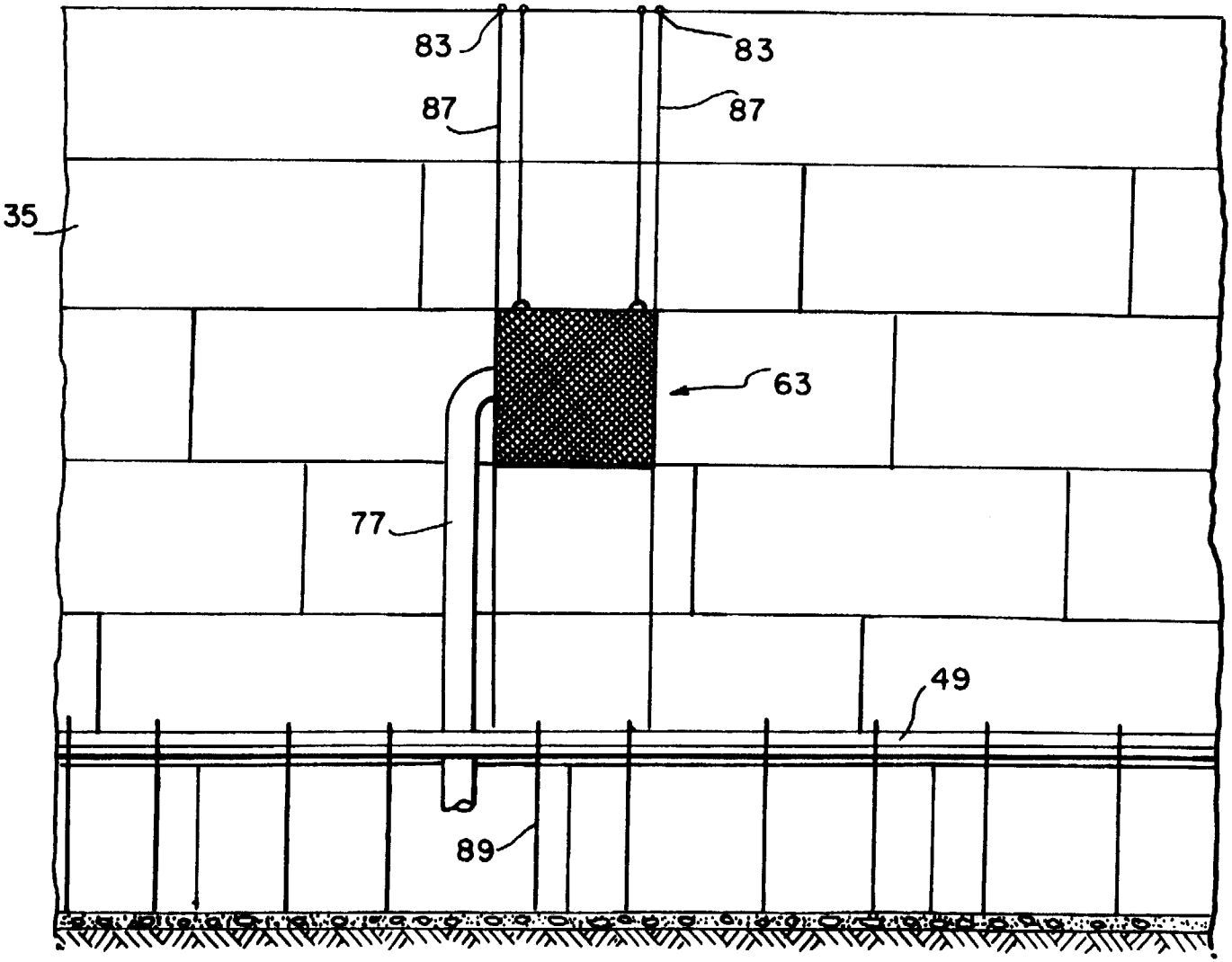
FIGS. 9, 10 and 11 ape front, side and top views respectively of the second sub-system meant to work against inside tank wall above roof.
Figure 10:
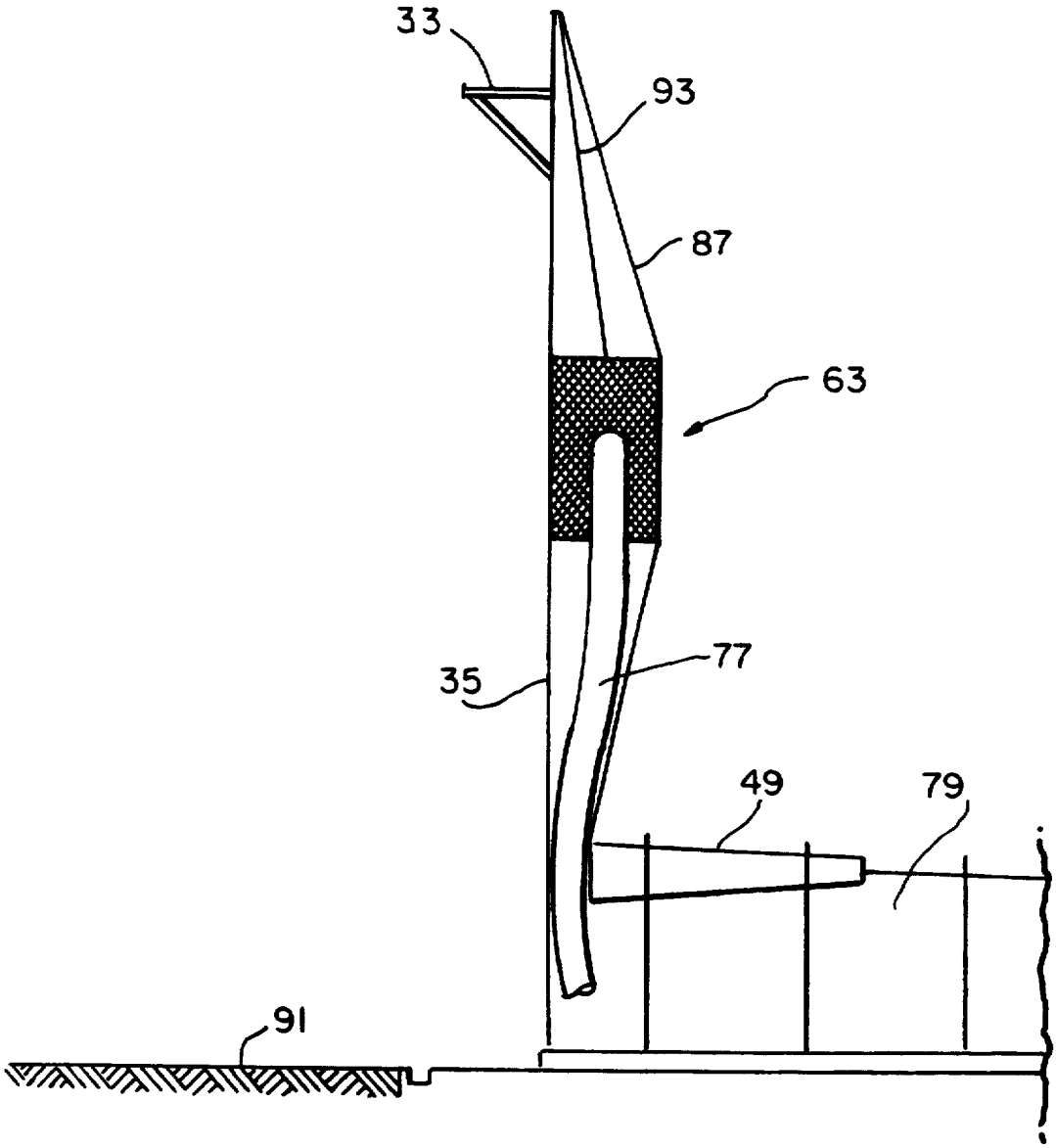
Figure 11:
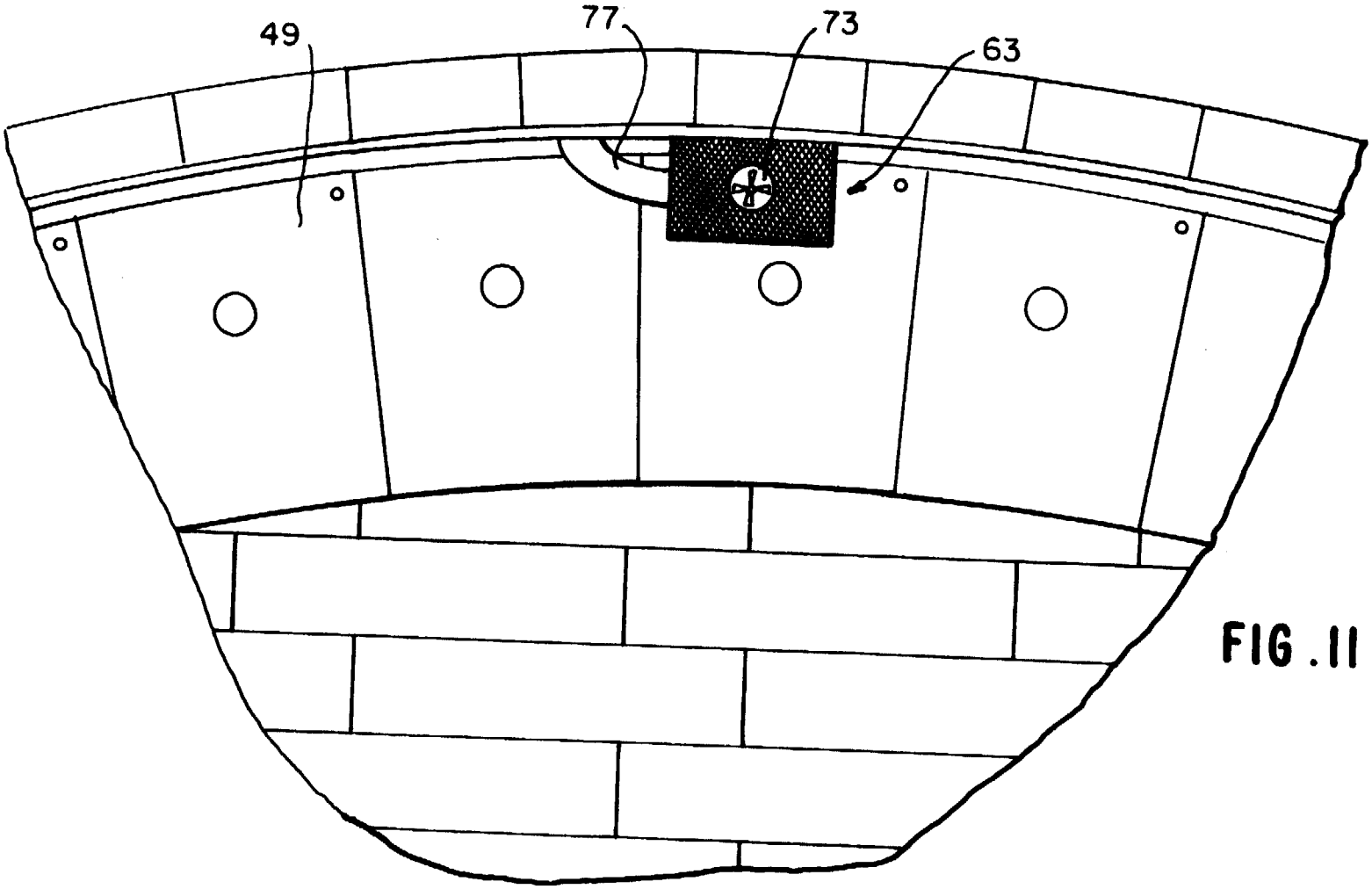
Figure 12:
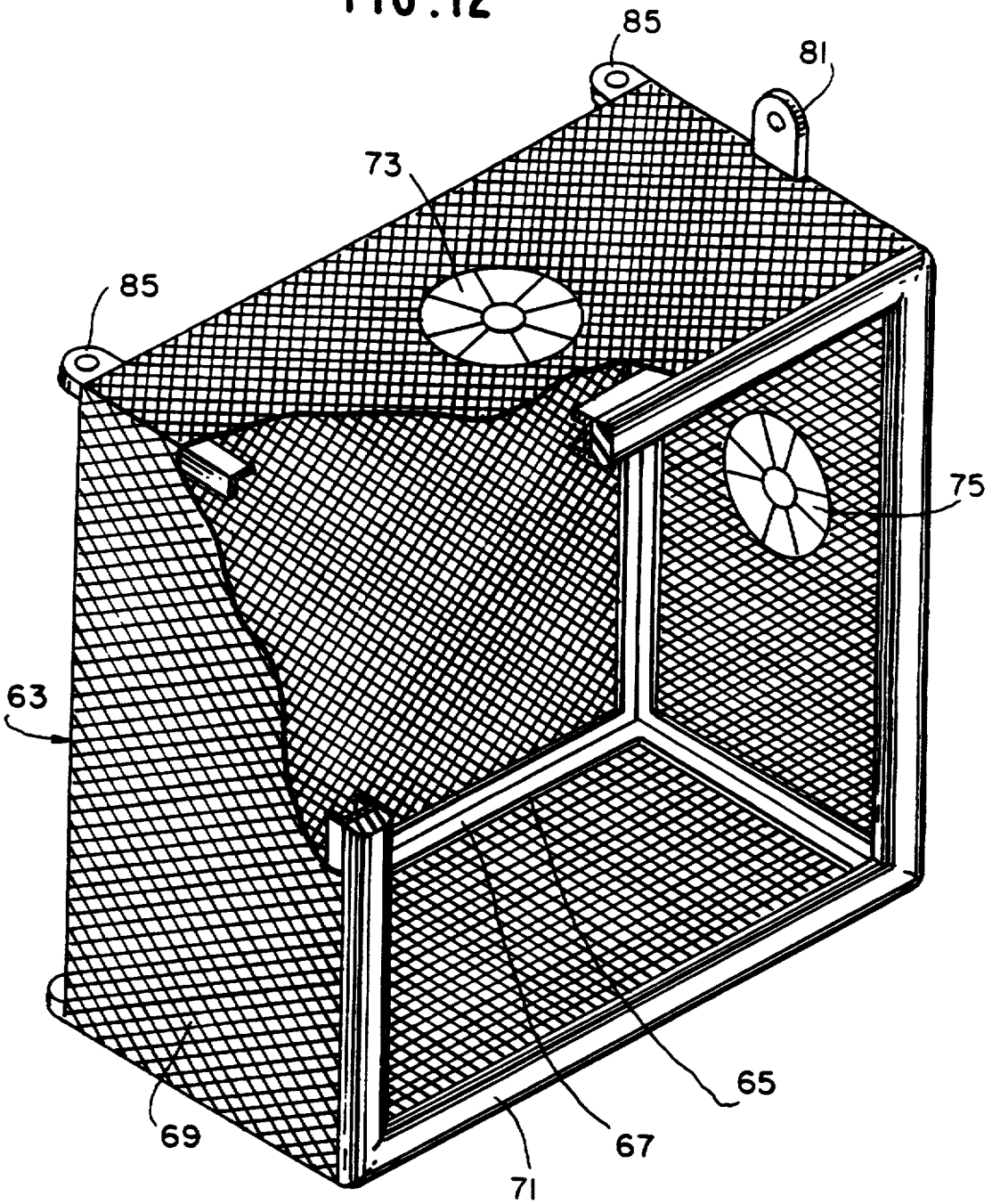
FIG. 12 is an enlarged view of the mobile containing chamber shown in FIGS. 9, 10 and 11.
Figure 13:
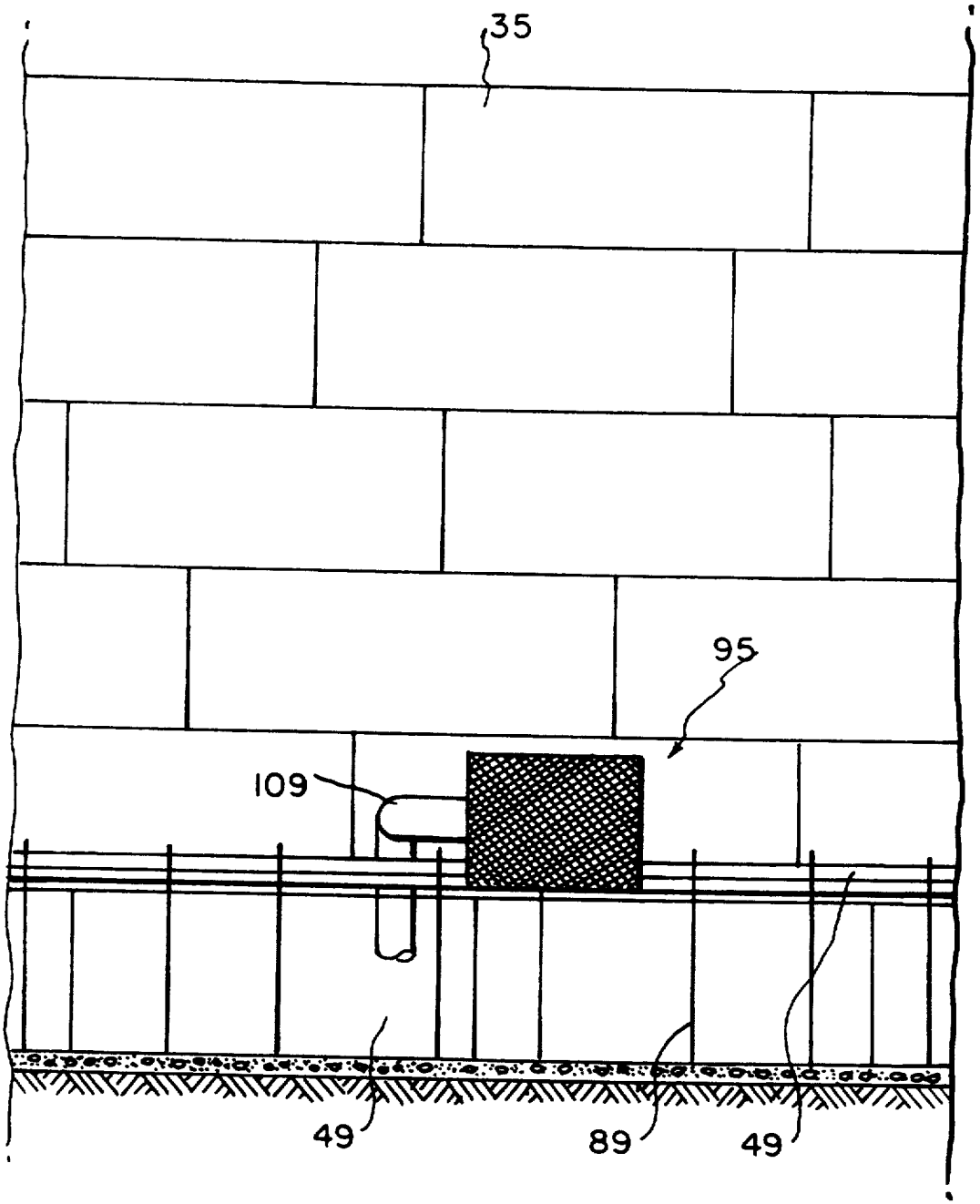
FIGS. 13, 14 and 15 are front, side and top views respectively of third sub-system that is to work on the outside of tank roof.
Figure 16:
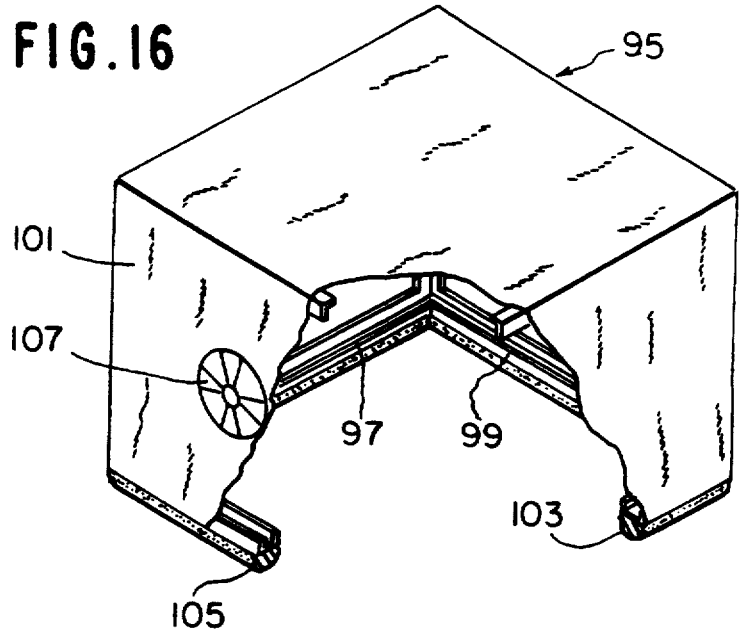
FIG. 16 is an enlarged view of containing chamber shown in FIGS. 13, 14 and 15.
Figure 14:
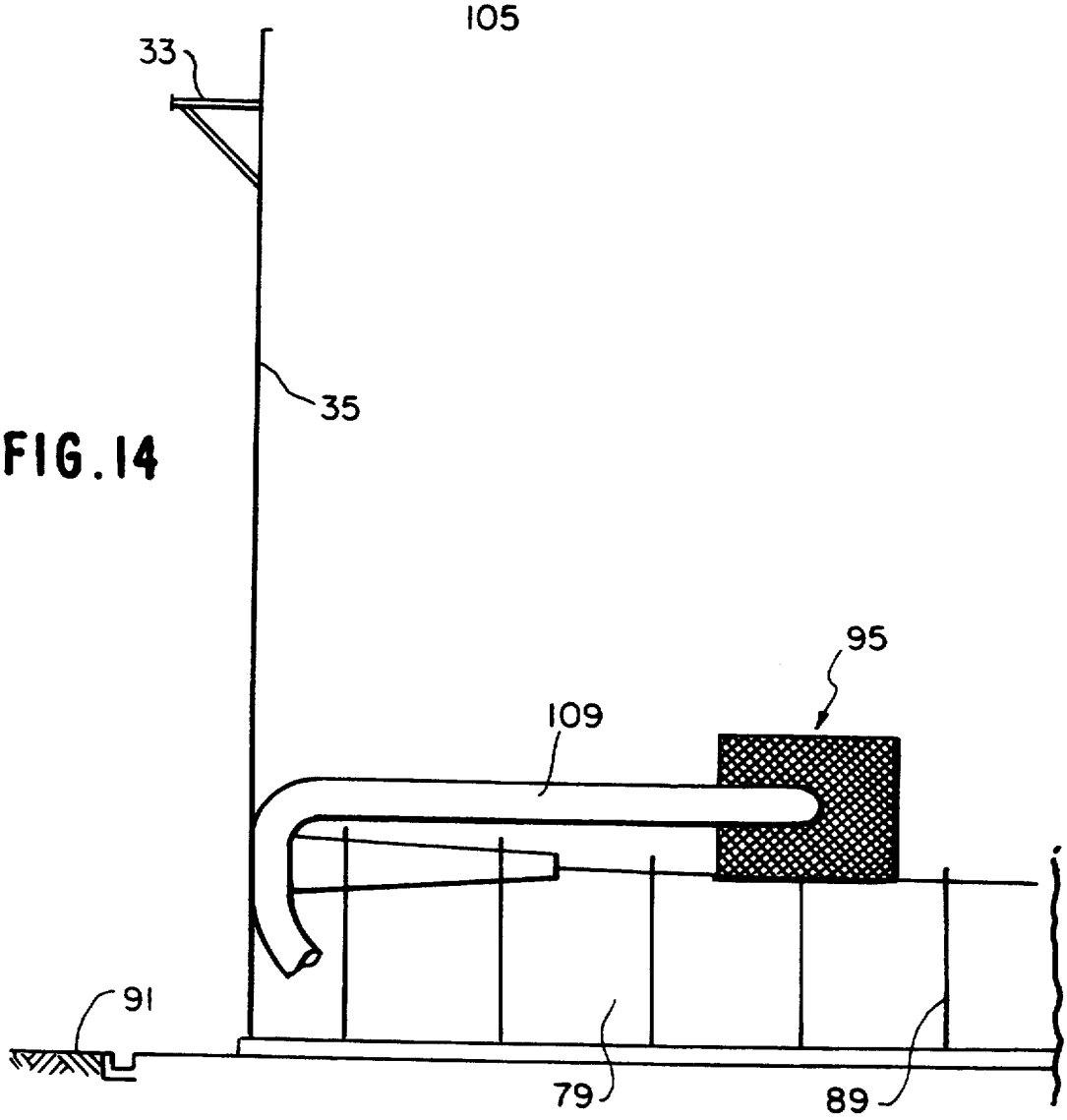
Figure 15:
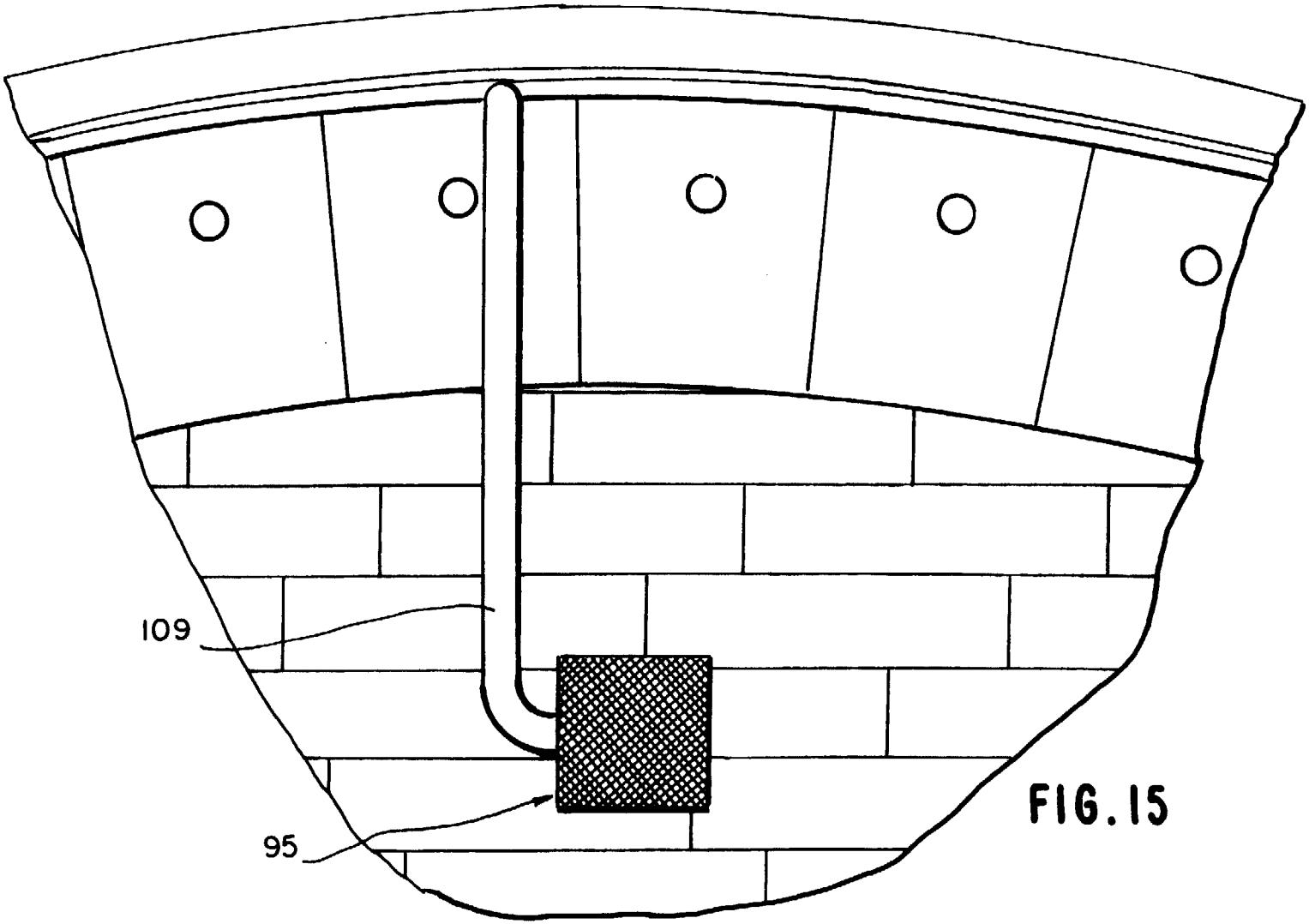

The second sub-system, shown in FIGS. 9, 10 and 11, and which is meant to work against the side of the tank above the roof of the tank which is a "floating roof" movable up and down within the tank, consists of a mobile holding chamber for tank (91) and a cable (93) to hoist mobile holding chamber (63), as shown in enlarged perspective in FIG. 12. Cross-section of said chamber (63) is rectangular in shape and consists of a frame (65) made of angle irons (67), a steel sheet cover (69), foam rubber (71) around front to seal off mobile chamber (63) and the back of the tank (35), a fan (73) at top, and a blower (75), at the side, from which a canvas duct (77) runs up to the inside of tank (79), It also includes handles (81) to lift mobile holding chamber (63), by means of pulleys (83) and guides (85) at top, for tighteners (87), to keep mobile holding chamber (63) close to side of tank (35). FIG. 10 shows details from bowl of holding tank (91) and cable (93) to hoist mobile holding chamber (63), Third sub-system, shown in FIGS. 13, 14 and 15 and which is meant to work on the outside of tank roof consists of holding chamber (95)—shown in enlarged perspective in FIG. 16—cross-section whereof is rectangular, comprising a frame (97) made up of steel angle irons (99) welded to or rising from scaffolding resting on tank roof (49), which frame is covered in with canvas (101), foam rubber (103), and surrounded by a coat of rubber (105) outside, to seal holding chamber (95) off from roof of tank (49), and blower (107) at the side, from which a canvas duct (109) of about 60 centimeters in diameter issues into the inside of tank (79).

In fourth sub-system which is meant to work inside the tank (bottom, inside of tank top and inside wall of tank below roof) particles of matter are held therein because of the shape of the area to be sandblated.

It should be mentioned that all tank openings leading to the outside will be closed while fans are to be installed at manholes to lead off air laden with particles of matter along canvas ducts up to the wet dust collectors.

The number of blasting nozzles for each sub-system that are meant to operate simultaneously is limited in terms of the number of wet dust collectors employed for each tank, and the system can operate with any combination of sub-systems.

I claim:

1. A system for gathering particulate matter used in sandblasting a storage tank having a floating roof comprising four distinct, independent sub-systems environmentally integrated to collect particulate matter subsequent to sandblasting, a first sub-system for operating against an outer side of a tank wall, a second sub-system for operating against an inner side of said tank wall above said roof, a third sub-system for operating against an outer surface of said roof and a fourth sub-system for operating in all regions within the tank below said roof;

said first sub-system comprising a containing tower assembled adjacent said tank and including pipe scaffolding supported on a ground surface adjacent the tank, extending above tank bracing at a top of the tank and extending down the inner tank wall, said containing tower including a plurality of blowers spaced apart on said containing tower and connected to a plurality of conduits respectively, one of said conduits extending downwardly inside said inner tank wall through a gap between said roof and said inner tank wall;

said second sub-system comprising a mobile containing chamber, means for raising and lowering said containing chamber in close proximity to said inner tank wall and a conduit connected to said mobile containing chamber and extending downwardly through a gap between said roof and said inner tank wall into an interior portion of said tank;

said third sub-system comprising a moving holding chamber, a conduit connected to said moving holding chamber and extending downwardly through a gap between said roof and said inner wall and said fourth sub-system being comprised of an inner surface of said roof and said inner side walls below said roof.

2. A system as set forth in claim 1, further comprising sealing means between said mobile containing chamber and said inner wall and between said moving holding chamber and said roof.

3. A system as set forth in claim 1, wherein a plurality of said conduits are connected to a wet dust collector.

4. A system as set forth in claim 3, wherein said wet dust collector is comprised of a housing having a plurality of horizontally extending baffles mounted therein, water jet openings disposed between said baffles and inlet means connected to said conduit means for directing particles laden air inwardly and upwardly through said wet dust collectors, air exhaust means located in an upper portion of said collector and wet dust particle collecting means located at a bottom of said collector.

5. A system as set forth in claim 1, wherein said mobile containing member is comprised of a plurality of welded angle irons to define a rectilinear frame, plate means covering said frame to define an opening adapted to be disposed adjacent said wall, sealing means disposed around said opening for sealing said chamber against said wall, conduit connecting means for connecting one of said conduits to said chamber and means for raising and lowering said chamber and holding said chamber against said wall.

6. A system as set forth in claim 1, wherein said moving holding chamber is comprised of a rectilinear frame covered with canvas and having a bottom opening, sealing means disposed about said opening for resting on an upper surface of said roof and means for connecting a conduit to said moving holding chamber.

* * * * *